US005346284A

United States Patent [19]

Dauphin

[11] Patent Number: 5,346,284

[45] Date of Patent: Sep. 13, 1994

[54] SEATING FURNITURE ARMREST

[75] Inventor: Friedrich W. Dauphin, Offenhausen, Fed. Rep. of Germany

[73] Assignee: Dauphin Entwicklungs- u. Beteiligungs-GmbH, Neukirchen, Fed. Rep. of Germany

[21] Appl. No.: 114,365

[22] Filed: Sep. 1, 1993

[30] Foreign Application Priority Data

Sep. 10, 1992 [DE] Fed. Rep. of Germany ..... 4230230

[51] Int. Cl.[5] ..... A47C 7/54

[52] U.S. Cl. ..... 297/411.36; 297/410

[58] Field of Search ..... 297/411.36, 410

[56] References Cited

U.S. PATENT DOCUMENTS

| | | | |
|---|---|---|---|
| 527,056 | 10/1894 | Gilson | 297/411.36 |
| 4,451,084 | 5/1984 | Seeley | 297/410 |
| 4,616,877 | 10/1986 | Slaats et al. | 297/410 |
| 4,786,108 | 11/1988 | Dauphin | 297/410 |
| 4,951,995 | 8/1990 | Teppo et al. | 297/411.36 |
| 5,121,969 | 6/1992 | Schroeder | 297/410 |
| 5,228,183 | 7/1993 | Saeki | 297/410 |

FOREIGN PATENT DOCUMENTS

| | | |
|---|---|---|
| 0166870 | 3/1985 | European Pat. Off. . |
| 317835 | 11/1988 | European Pat. Off. . |
| 2253819 | 5/1974 | Fed. Rep. of Germany . |
| 4002499 | 1/1990 | Fed. Rep. of Germany . |
| 061217 | 5/1990 | Fed. Rep. of Germany . |
| 2505158 | 11/1982 | France . |

*Primary Examiner*—John T. Kwon

*Attorney, Agent, or Firm*—Browdy and Neimark

[57] ABSTRACT

An armrest for seating furniture is provided with a guide column extending in the vertical direction, with an armrest body which is guided thereon telescopically displaceably by virtue of a counter guide and with a locking device arranged on the armrest body for vertically fixing the armrest body in relation to the guide column. The guide column and the counter guide of the armrest body are formed in such symmetrical :manner in relation to an axis of symmetry extending in the vertical direction, that the armrest body is securable on the guide column in two different assembly positions rotated by 180° about the axis of symmetry one referred to the other.

13 Claims, 4 Drawing Sheets

FIG.5
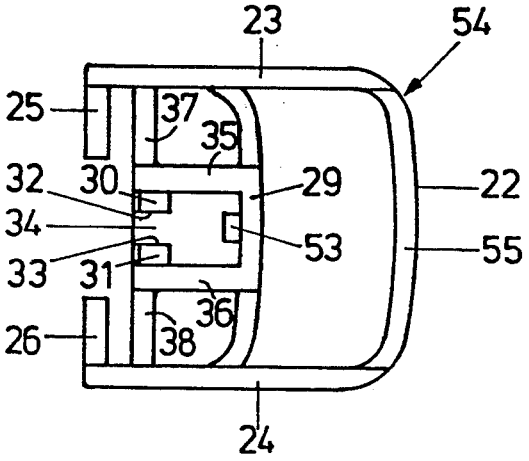
FIG.7
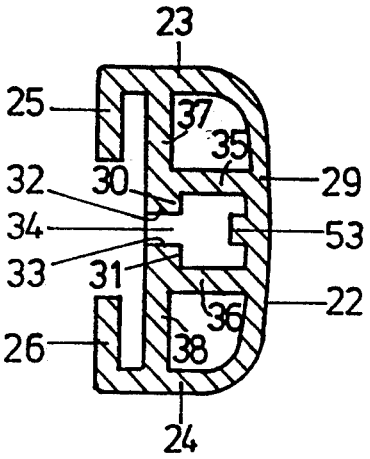
FIG.8
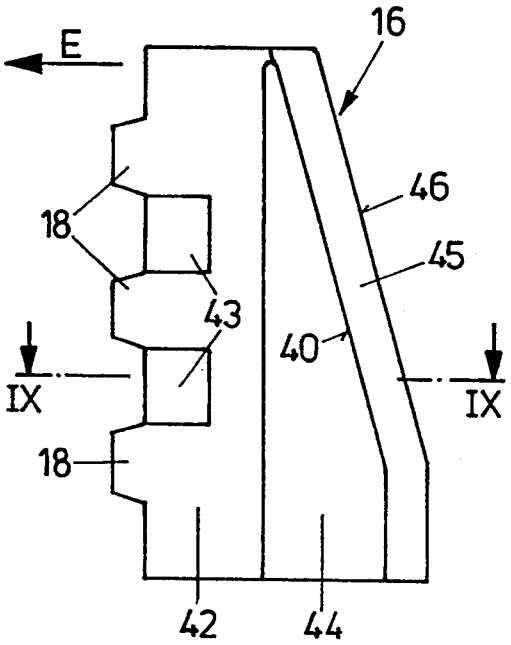
FIG.6
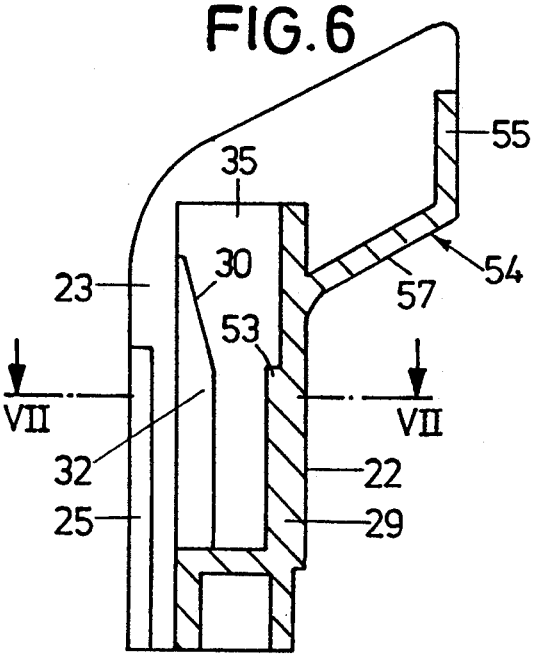
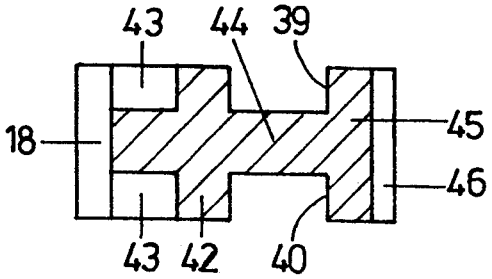
FIG.9

SEATING FURNITURE ARMREST

BACKGROUND OF THE INVENTION

1. Field of the Invention

The invention relates to an armrest for seating furniture and in particular for office chairs comprising a guide column extending in a vertical direction, an armrest body which is guided thereon telescopically displaceably by means of a counter guide, which armrest body comprises an arm bearing surface, a locking device arranged on the armrest body for vertically fixing the armrest body in relation to the guide column, which locking device comprises a locking member releasably engaging with a locking recess on the guide column.

2. Background Art

An armrest of this type is known from EP 0 166 870. In this armrest it is provided to arrange the armrest body, which is arranged adjustable in height on a guide column, in different positions in relation to the seating furniture, in order to be able to variably adjust for instance the distance from the armrest front edge to the seat front edge. For this variable adjustment the guide column, which is arranged inclined towards the vertical line, together with the armrest body can be mounted on the seat in an oblique inclination towards the front or the back, respectively. Insofar it is necessary to remount in complicated manner the guide column on the seating furniture.

SUMMARY OF THE INVENTION

Based on these problems it is the object of the invention to further improve an armrest of the generic type in such manner that it is possible to particularly simply remount the armrest.

This object is attained by an armrest, wherein the guide column and the counter guide of the armrest body are formed in such symmetrical manner in relation to an axis of symmetry extending in the vertical direction, that the armrest body is securable on the guide column in two different assembly positions rotated by 180° about the axis of symmetry one referred to the other. Consequently, the armrest can again be mounted the guide column by simply drawing the armrest body off the guide column and by an assembly rotated by 180° about the axis of symmetry. Insofar remounting restricts to disengagement of the locking member from the locking recess, drawing the armrest body off the guide column, ting the armrest body, mounting it again onto the guide column and producing the locking connection between locking member and locking recess. Hereby it is possible to change very quickly for instance the distance from the armrest front edge to the seat front edge, if an armrest body with different distances from its two ends of the arm bearing surface the axis of symmetry is used. This is especially advantageous, if the office chair equipped with an armrest according to the invention is to be used in different countries with differing standards for the design and dimensioning of office chairs.

A preferred embodiment of the invention relates to an armrest, wherein each case one row of locking recesses extending in the vertical direction is arranged on two lateral surfaces facing away from each other and extending in the vertical direction, of the guide column. By this embodiment an assembly of the armrest body is possible in two different positions of rotation as well as in different vertical positions with regard to the guide column. Thus an armrest is achieved which can be turned and be adjusted in height at the same time, a single locking device disposed on the armrest body being responsible for fixing the arm rest body in relation to the guide column.

Claim 4 and claims 5 to 13 which refer to the latter characterize an embodiment of the armrest concerning an actuating device for the locking member of the locking device on the armrest body. These embodiments in the one hand are to be employed with particular advantage in the armrest according to claims 1 to 3, which armrest can be turned and adjusted in height. Independent from the turnability of the armrest subject matter of claims 4 to 13 can be used also with an armrest which is merely adjustable in height, however, cannot be turned, in which the armrest body is guided by means of a countersupport in a telescopically displaceable manner on a guide column extending in the vertical direction and in which the armrest body comprises a locking device for vertically fixing the armrest body in relation to the guide column.

Accordingly, the invention relates to an advantagous embodiment of the armrest, wherein the locking member is disengageable with the locking recesses by means of an actuating device on the armrest body, and wherein the actuating device comprises an actuating slide supported on the armrest body displaceably at right angles to the direction of engagement of the locking member, which actuating slide can be connected in the nature of a push drive with a locking member via wedge surfaces, adjoining each other, of locking member and actuating slide. By means of this embodiment the locking member of the locking device on the armrest body can be disengaged with the locking recess on the guide column. The special merits of this actuating device are a simple and easy-running operation.

By the preferred embodiment according to which with a wedge surface directing opposite the direction of engagement of the locking member the actuating slide undercuts a wedge surface directing in the direction of engagement on the locking member, a positive actuation of the locking member via the actuating slide is achieved, so that it is ensured at any time that the locking member can be released from the locking recesses.

According to another preferred embodiment of the invention a closing wedge spring-loaded in the closing direction of the actuating slide is supported on the actuating slide displaceably at right angles to the direction of engagement of the locking member, which closing wedge with a wedge surface directing in the direction of engagement drives a wedge surface directing opposite to the direction of engagement on the locking member and is supportable on the actuating slide opposite to its opening direction. By this construction the locking engagement of the locking member is performed independent from an operation of the actuating slide. More details can be taken from the description of the example of embodiment.

Further preferred embodiments permit a particularly compact design of the locking device and the actuating device. Furthermore, by means of this the actuating slide with its external walls can be arranged in freely accessible manner on the external side of the armrest body, so that the actuating slide evidently comes to the fore as a function element and is well accessible for operation.

By means of an additional projection on the actuating slide according to another preferred embodiment of the invention on the one hand an actuating surface easing operation is created and the actuating slide is additionally guided on the armrest body.

A further preferred embodiment of the invention provides for a constructionally simple embodiment of the guidance for the locking member in its direction of engagement.

Further preferred embodiments of the invention relate to measures, by which a safeguard is given against inadvertently drawing the armrest body off the guide column.

By the arrangement of the actuating slide and the locking member in the longitudinal direction of the armrest in alignment with the guide column the armrest is formed in a particularly narrow manner in the longitudinal direction of the armrest.

BRIEF DESCRIPTION OF THE DRAWINGS

Further features, details and advantages of the invention will become apparent from the ensuing description of an example of embodiment taken in conjunction with the drawing.

FIG. 5 shows a plan view of the actuating slide of the armrest, FIG. 6 shows a vertical cut of the actuating slide, FIG. 7 shows a horizontal cut of the actuating slide along the line VII—VII according to FIG. 6, FIG. 8 shows a side view of the locking bolt of the armrest and FIG. 9 shows a horizontal cut of the locking bolt along the line IX—IX according to FIG. 8.

DESCRIPTION OF THE PREFERRED EMBODIMENT

Figure 1:
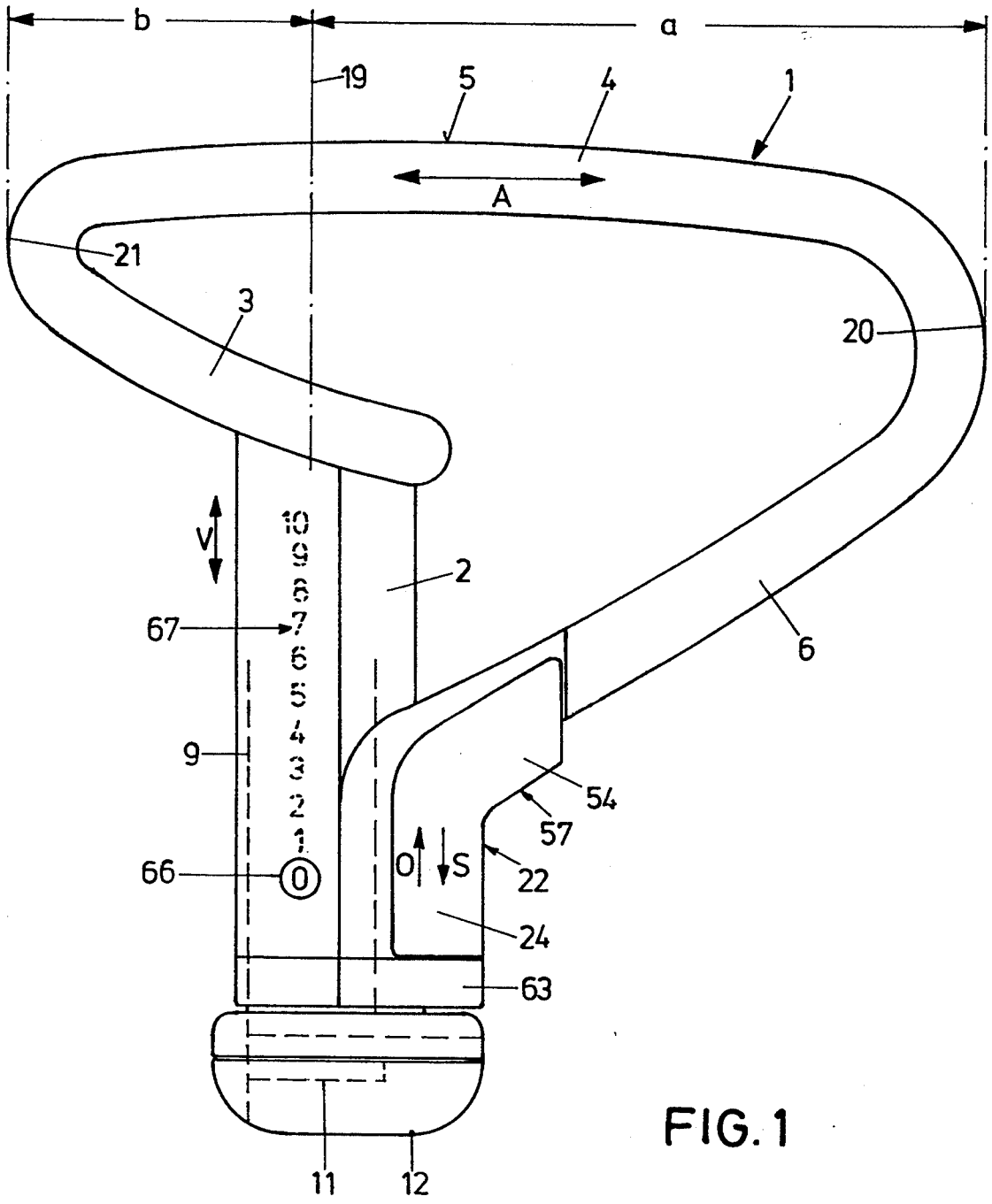
FIG. 1 shows a side view of an armrest.

As it becomes apparent from FIG. 1, the armrest comprises an armrest body 1 with a vertically extending, column-shaped base portion 2. From its upper end a link leg 3 projects in ascending manner in the longitudinal direction A of the armrest, which link leg 3 passes into the bearing surface leg 4, extending approximately horizontally in the longitudinal direction A of the armrest, of the armrest body 1. The bearing surface leg 4 forms with its surface the arm bearing surface 5 of the armrest body 1.

On its end facing away from the link leg 3 the bearing surface leg 4 passes into a further link leg 6, which opens out below half the height of the base portion 2 into the latter.

Figure 2:
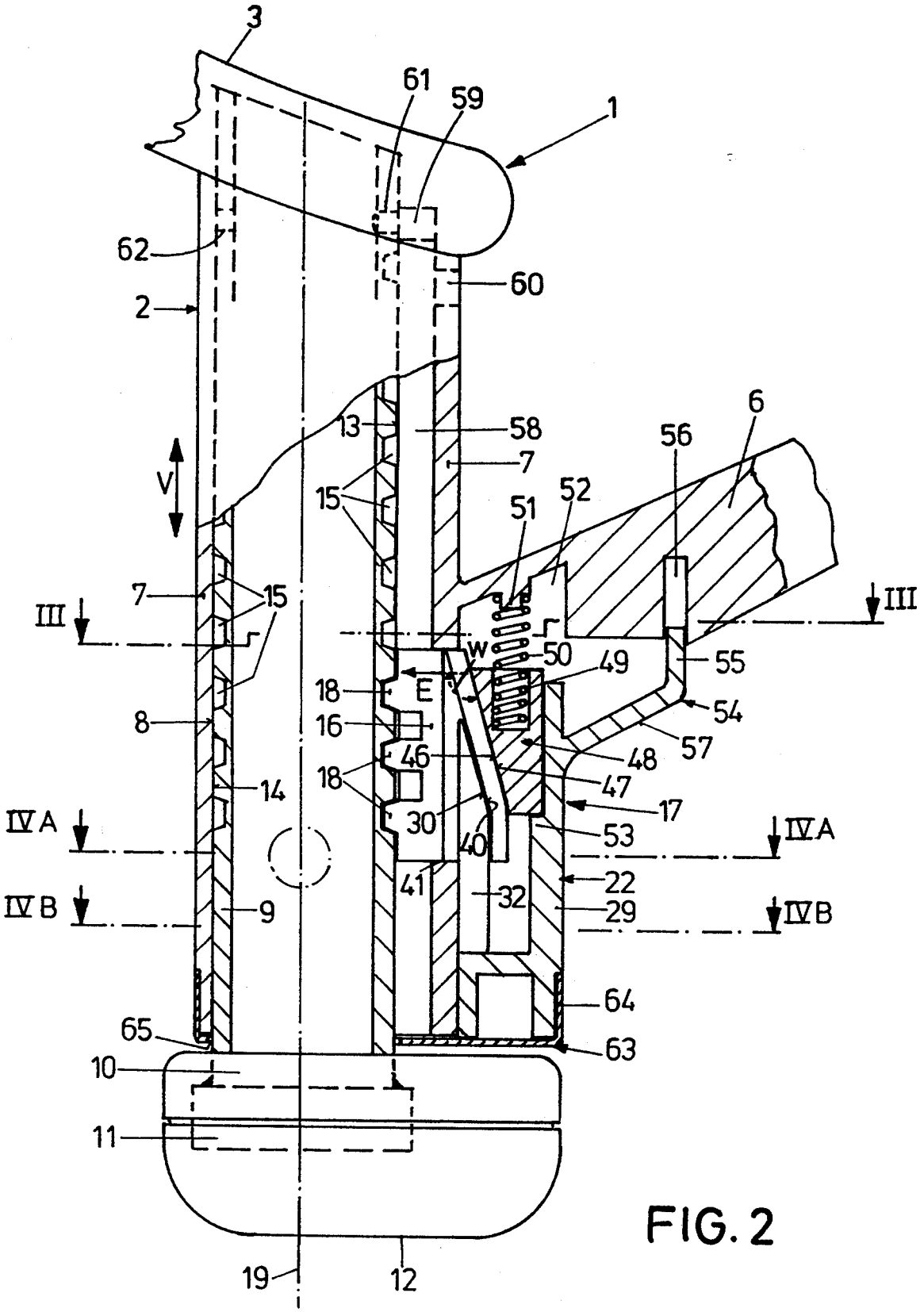
FIG. 2 shows an enlarged partial side view of the armrest according to FIG. 1 in a partially vertically cut illustration.
Figure 3:
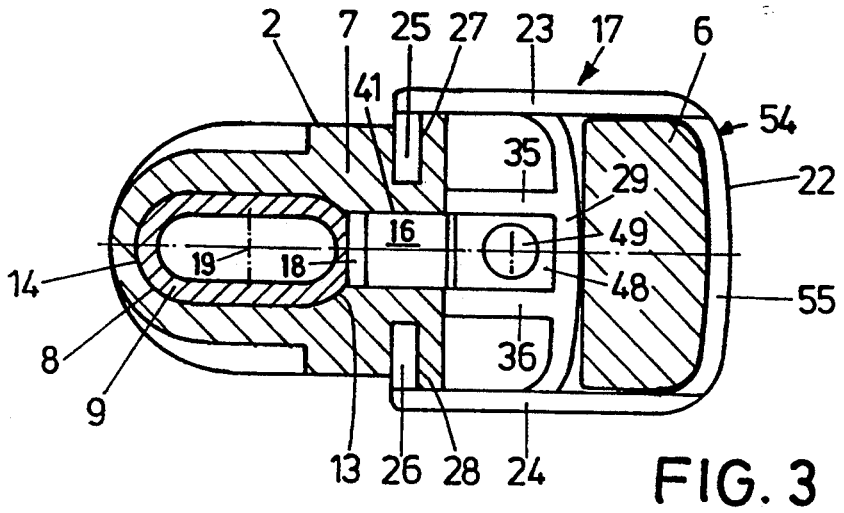
FIG. 3 shows a horizontal cut of the armrest along the line III—III according to FIG. 2, FIG. 4 in the upper part A shows a vertical cut of the armrest along the line IVA—IVA according to FIG. 2 and in the lower part B a horizontal cut along the line IVB—IVB according to FIG. 2.
Figure 4:
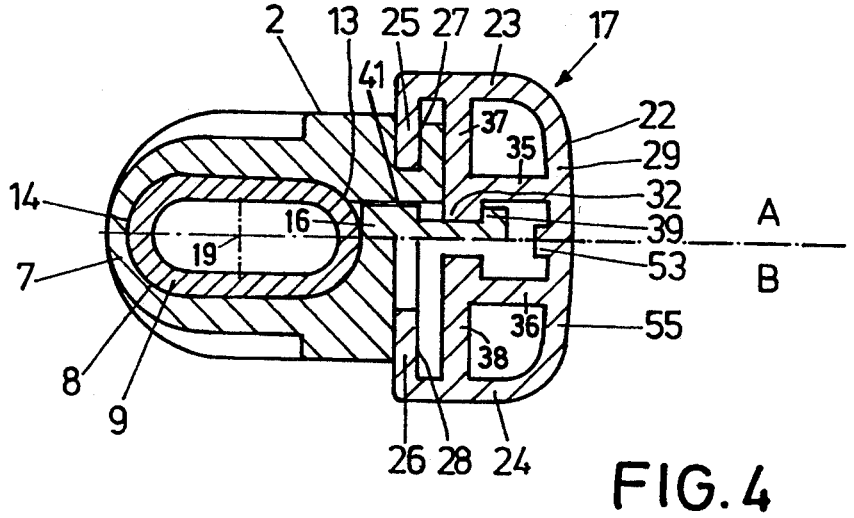

As it becomes clear from FIGS. 2 to 4, the base portion 2 of the armrest body 1 with its vertical wall 7 forms a guide opening 8, which in its internal cross-section has the shape of an oblong hole and which extends beyond the height of the armrest body 1, with which guide opening 8 the armrest body 1 is guided in telescopically displaceable manner on the guide column 9 comprising a corresponding external cross-section in the shape of an oblong hole.

With its lower end 10 the guide column 9 is secured to a retaining brace 11 formed as a flat iron, which produces the connection of the armrest with the seating furniture. The connecting area between the guide column 9 and the retaining brace 11 is covered by a two-part cap 12.

On its two semicircular lateral surfaces 13, 14 facing away from each other the guide column 9 comprises one row respectively, extending in the vertical direction V, of locking recesses 15 disposed at a distance from each other. A locking member formed as a locking bolt 16 of a locking device on the armrest body 1 denoted as a whole with 17 engages in each case with a group of three of the locking recesses 15 located adjacent each other in a row for fixing the armrest body 1 in a certain vertical position in relation to the guide column 9. After releasing the locking engagement of the three locking projections 18 formed on the locking bolt 16 from the corresponding locking recesses 15, the armrest body 1 as a whole can be drawn off the guide column 9; due to the symmetrical design of the guide column 9 and the guide opening 8 with regard to the axis of symmetry 19 extending in the vertical direction V the armrest body 1 can be pushed again onto the guide column 9 in an assembly position rotated by 180° about the axis of symmetry 19 and can be fastened on the guide column 9 in a certain vertical position by means of the locking bolt 16. As the armrest body with its base portion 2, the link legs 3, 6 and the bearing surface leg 4 is embodied in such manner that the two ends 20, 21 facing away from each other of the arm bearing surface 5 have different distances a, b from the axis of symmetry 19, two different distances of these ends 20, 21 from the seat front edge (not shown) of the seating furniture equipped with the armrest according to the invention can be obtained by means of rotating the armrest body 1.

The construction of the locking device 17 is described below in detailed manner in connection with FIGS. 2 to 9. It comprises an actuating device in the shape of an actuating slide 22, which is supported on the base portion 2 of the armrest body 1 displaceably at right angles to the direction of engagement E of the locking bolt 16 into the locking recesses 15, which actuating slide 22 is substantially U-shaped in its external cross-section (FIG. 4 and 7). The external walls 23, 24 forming the U-legs comprise guide webs 25, 26 projecting inwards, which engage with corresponding guide grooves 27, 28 in the wall 7 of the base portion 2, The actuating slide 22 extends from the lower end of the base portion 2 to the opening area of the link leg 6 into this base portion 2. The parts of the locking device 17 and the actuating device, which effect release and production of the locking engagement between the locking projections 18 on the locking bolt 16 and the locking recesses 15 in the guide column 9, are arranged within the internal space, which in the actuating slide 22 is formed by its external walls 23, 24 and by the external wall 29 connecting the latter. With regard to the actuating slide 22 these are primarily the two wedge surfaces 30, 31 facing away from the direction of engagement E, which approximately centrally in the internal space of the actuating slide 22 are formed by the inclined end of the wedge webs 32, 33 extending in the vertical direction V. The two wedge webs 32, 33 form between them a gap 34 open in the direction of engagement E. They are located on two bearing webs 35, 36 of the actuating slide 22, which bearing webs 35, 36 are vertically arranged and at a distance from each other and which direct in the direction of engagement E. On their external side facing away from the wedge webs 32, 33 the bearing webs 35, 36 are connected with the external walls 23, 24 via supporting webs 37, 38.

The wedge surfaces 30, 31 interact with correspondingly aligned wedge surfaces 39, 40 on the locking bolt 16. Approximately in the opening area of the link leg 6 into the base portion 2 of the armrest body 1 this locking bolt 16 is supported in a wall opening 41 of the wall 7 of the base portion 2 displaceably in the direction of engagement E. The locking bolt 16 consists substantially of an oblong, cuboidal block 42, which is arranged at right angles to the direction of engagement E in the wall opening 41 and which carries the locking projections 18 on its front side directing in the direction of engagement E. Between the locking projections 18 lateral recesses 43 are provided. On the side opposite the locking projections 18 of the block 42 a plate 45 extending in oblique manner to the direction of engagement E is formed over a central intermediate web 44, the side, directing in the direction of engagement E and flanking the intermediate web 44, of which plate 45 forms the two wedge surfaces 39, 40 of the locking bolt 16. In the assembly position of locking bolt 16 and actuating slide 22 facing each other, which is shown in FIGS. 2 to 4, the intermediate web 44 extends in the gap 34 of the actuating slide 22 between its two wedge webs 32, 33.

The external side, directing in the direction of engagement E, of the plate 45 forms a further wedge surface 46, which interacts with a wedge surface 47 of a closing wedge 48. This closing wedge 48 is supported in the internal space of the actuating slide 22 between its external wall 29 and the two bearing wedges 35, 36 displaceably at right angles to the direction of engagement E of the locking bolt 16. In its side directing vertically upwards the closing wedge 48 is provided with a blind hole 49, in which a helical compression spring 50 outlined in FIG. 2 with a dot-dash line rests with one end, and with its other end supports on a bearing projection 51 in a recess 52 of the link leg 6. Thus the closing wedge 48 is spring-loaded in the vertically downward extending closing direction S (FIG. 1) of the actuating slide 22. Vertically below the closing wedge 48 a vertically extending driving web 53 is provided on the internal side of the external wall 29 of the actuating slide 22.

Furthermore, the actuating slide 22 is provided with a projection 54, which projects from its external wall 29 forming the U-base outwards substantially at right angles to the vertical direction V, which projection 54 in turn is approximately U-shaped in its horizontal cross-section (FIGS. 3, 5). On its free end a further guide web 55 is provided, which engages with a corresponding guide groove 56 on the bottom side of the link leg 6 of the armrest body 1.

As becomes clear from FIG. 1, the actuating slide 22 together with its projection 54 forms an actuating element appearing from outside as an angled part with an easy-to-operate handle surface 57.

In the vertical direction V and in alignment with the locking bolt 16 the guide opening 8 comprises a groove 58 extending over the entire height of the base portion 2, with which groove 58 engages a stop pin 59 arranged on the upper end of the guide column 9. On the upper end of the wall 7 of the base portion 2 with the armrest body 1 being placed on the guide column 9 the stop pin 59 can be screwed into a corresponding thread opening 61 at the guide column 9 via an assembly opening 60 opening out into the groove 58. A corresponding thread opening 62 is provided in the same level in the opposite lateral surface 14 of the guide column 9, in order to fasten the stop pin there in the turned state of the armrest body 1.

The lower ends of basis portion 2 and actuating slide 22, which end in flush manner, are surrounded by a common cap 63 with lateral, circumferential collars 64. The cap 63 is lockable with the base portion 2 and additionally guides the actuating slide 22 in its closing direction S or opening direction O, respectively. The vertically downward directing surface of the cap 63 comprises an opening 65, through which penetrates the guide column 9.

With the aid of the cap 63 the armrest body 1 together with the locking bolt 16, the actuating slide 22, the closing wedge 48 and the helical compression spring 50 can be mounted as a closed assembly unit, which subsequently is pushed onto the guide column 9 and is interlocked with the latter.

On the external surfaces connecting the lateral surfaces 13, 14 of the guide column 9 one series of numbers 67 at a time extending in the vertical direction V is disposed, the numbers 0–10 of which in each case can be read individually via a window 66 in the corresponding wall section of the base portion 2. In the lowest position of the armrest body 1 shown in FIG. 1 for instance the number "0" can be seen from outside.

The function of the locking device 17 is described in detail below.

FIG. 2 shows the lowest position of the armrest in relation to the guide column 9, in which position the locking bolt 16 with its locking projections 18 engages with the three lowest locking recesses 15 of the row of locking recesses 15 arranged in the lateral surface 13 of the guide column 9. Engagement is ensured by the closing wedge 48, which is pressed downwards in the closing direction of the actuating slide 22 by means of the helical compression spring 50. Via the wedge surfaces 47, 46 on the closing wedge 48 and the locking bolt 16 the latter is driven in the direction of engagement E and the locking is fixed. Due to the large, acute angle W of approximately 75°, which the wedge surfaces 46, 47 take up towards the direction of engagement E, the slide connection between the closing wedge 48 and the locking bolt 16 produced via the wedge surfaces 46, 47 is self-locking, the necessary size of the angle W, which is occupied by the wedge surfaces 46, 47 with the direction of engagement E to produce self-locking, depending on the coefficient of friction in this area.

For releasing the locking bolt 16 the actuating slide 22 is operated in its opening direction O directing vertically upwards. On this occasion the driving web 53 drives the closing wedge 48 upwards opposite to the drive action by the helical compression spring 50, by means of which the wedge connection between the wedge surfaces 46, 47 is disengaged and the locking bolt 16 is released. Directly afterwards the wedge surfaces 30, 31 on the actuating slide 22 are engaged with the corresponding wedge surfaces 39, 40 on the locking bolt 16, in case of a further displacement of the actuating slide 22 in the opening direction O, which causes the latter to be moved oppositely to its direction of engagement E. After the locking bolt 16 has been displaced as far as its locking projections 18 have completely come out of the locking recesses 15, the armrest body 1 can be displaced in relation to the guide column 9 in the vertical direction in another height position. If the actuating slide 22 is now released, it is automatically displaced by means of the force of the helical compression spring 50 in its closing direction S, as a result of which the engagement between the wedge surfaces 30, 31 on the actuating slide 22 and the wedge surfaces 39, 40 on the locking bolt 16 is released. Simultaneously: via its wedge surface 44 the closing wedge 48 drives the wedge surface 46 of the locking bolt and redisplaces the latter in the direction of engagement E, so that the locking engagement between the locking projections 18 and the locking recesses 15 is reproduced and the armrest body 1 is fixed in a corresponding height position on the guide column 9.

In this case it is not possible to completely draw off the armrest body 1 as when the drawing movement is accomplished the locking bolt 16 abuts on the stop pin 59. Therefore, for the purpose of turning the armrest body 1, after operating the actuating slide 22 the armrest body 1 must be brought into a height position, in which the assembly opening 60 is in alignment with the stop pin 59 and the latter can be screwed out. Then the armrest body 1 can be completely drawn off the guide column 9, can be rotated by 180° about the axis of symmetry 19 and can be replaced onto the guide column 9 in the desired height position. Hereby file stop pin 59 is to be screwed into the thread opening 62 located opposite to the thread opening 61 via the assembly opening 60.

What is claimed is:

1. An armrest for seating furniture, in particular for office chairs, comprising a guide column (9) extending in a vertical direction (V), an armrest body (1) which is guided thereon telescopically displaceably by means of a counter guide, which armrest body (1) comprises an arm bearing surface, a locking device (17) arranged on the armrest body (1) for vertically fixing the armrest body (1) in relation to the guide column (9), which locking device (17) comprises a locking member (16) releasably engaging with a locking recess (15) on the guide column (9), wherein the guide column (9) and the counter guide (8) of the armrest body (1) are formed in such symmetrical manner in relation to an axis symmetry (19) extending in the vertical direction (V), that the armrest body (1) is securable on the guide column (9) in two different assembly positions rotated by 180° about the axis of symmetry (19) one referred the other.

2. An armrest according to claim 1, wherein in each case a row of locking recesses (15) extending in the vertical direction (V) is arranged on two lateral surfaces (13, 14), facing away from each other and extending in the vertical direction (V), of the guide column (9).

3. An armrest according to claim 1, comprising two ends (20, 21), facing away from each other, of the arm bearing surface (5) having different distances (a, b) from the axis of symmetry (19).

4. Armrest according to claim 1, wherein the locking member (16) is disengageable with the locking recesses (15) by means of an actuating device on the armrest body, and wherein the actuating device comprises an actuating slide (22) supported on the armrest body displaceably at right angles to the direction of engagement (E) of the locking member (16), which actuating slide (22) can be connected in the nature of a push drive with a locking member (locking bolt 16) via wedge surfaces (30, 31, 39, 40), adjoining each other, of said locking member (16) and said actuating slide (22).

5. An armrest according to claim 4, wherein with a wedge surface (30, 31) directing opposite the direction of engagement (E) of the locking member (16) the actuating slide (22) undercuts a wedge surface (39, 40) directing in the direction of engagement (E) on the locking member (16).

6. An armrest according to claim 4, wherein a closing wedge (48) spring-loaded in the closing direction (S) of the actuating slide (22) is supported on the actuating slide (22) displaceably at right angles to the direction of engagement (E) of the locking member (16), which closing wedge (48) with a wedge surface (47) directing in the direction of engagement (E) drives a wedge surface (46) directing opposite to the direction of engagement (E) on the locking member (16) and is supportable the actuating slide (22) opposite to its opening direction (O).

7. An armrest according to claim 6, wherein the actuating slide (22) comprises a substantially U-shaped external cross-section, its wedge surfaces (30, 31), the part of the locking member (16) comprising the corresponding wedge surfaces (39, 40) and the closing wedge (48) being arranged within the internal space of the actuating slide surrounded by external walls (23, 24, 29) of the actuating slide (22).

8. An armrest according to claim 7, wherein the actuating slide (22) is displaceably supported on the external side of the armrest body (1) via guide webs (25, 26) projecting inwards from the external walls (23, 24) of the armrest body (1), which guide webs (25, 26) engage with corresponding guide grooves (27, 28) on the armrest body (1).

9. Armrest according to claim 7, wherein the actuating slide (22) is provided with a projection (54) projecting from a U-base portion (external wall 29) outwards substantially at right angles to the direction of displacement (V), at the free end of which projection (54) a further guide web (55) for engaging with a corresponding guide groove (56) is formed on the armrest body (1).

10. An armrest according to claim 4, wherein the locking member (16) supported displaceably in the direction of engagement (E) in a wall opening (41) of a wall (7), surrounding the guide column (9) and forming an inner guide opening (8), of the armrest body (1).

11. An armrest according to claim 10, wherein the wall (7), surrounding the guide column (9), of the armrest body comprises a groove (58) extending in the vertical direction (V) and being aligned with the locking member (16), with which groove (58) engages a stop (59) arranged on an upper end of the guide column (9).

12. An armrest according to claim 11, wherein the stop (11) can be mounted and dismounted via an opening (60) in the armrest body (1) with the armrest body (1) being placed onto the guide column (9).

13. An armrest according to claim 4, wherein actuating slide (22) and locking member (16) are arranged in the longitudinal direction of the armrest (A) in alignment with the guide column (9).

* * * * *